United States Patent [19]

Dorner

[11] 4,008,128

[45] Feb. 15, 1977

[54] TUBE FURNACE, ESPECIALLY FOR THE CRACKING OF HYDROCARBONS

[75] Inventor: Armin Dorner, Baierbrunn, Germany

[73] Assignee: Linde Aktiengesellschaft, Wiesbaden, Germany

[22] Filed: May 6, 1974

[21] Appl. No.: 467,605

[30] Foreign Application Priority Data

May 9, 1973 Germany ..... 2323234

[52] U.S. Cl. ..... 196/110; 122/356; 196/115; 196/116; 208/132

[51] Int. Cl.[2] ..... B01D 1/12; C10G 9/18

[58] Field of Search ..... 196/110, 115, 116, 133, 196/155; 122/356; 208/132; 159/28 VH

[56] References Cited

UNITED STATES PATENTS

| | | | |
|---|---|---|---|
| 1,885,716 | 11/1932 | Harnsberger | 196/110 |
| 1,889,861 | 12/1932 | Huet | 122/356 X |
| 1,938,406 | 12/1933 | Thomas | 196/110 X |
| 2,081,970 | 6/1937 | Alther | 196/116 X |
| 2,211,903 | 8/1940 | McCarthy | 196/116 X |
| 2,698,349 | 12/1954 | Bills | 23/277 R |
| 2,856,902 | 10/1958 | Throckmorton et al. | 122/356 |
| 2,902,981 | 9/1959 | Throckmorton et al. | 122/356 |
| 2,908,631 | 10/1959 | Allen | 196/116 X |
| 2,917,564 | 12/1959 | Pollock | 196/116 X |
| 2,994,724 | 8/1961 | Hillard et al. | 196/116 |
| 3,113,843 | 12/1963 | Li | 23/285 |
| 3,269,363 | 8/1966 | Guerrieri | 122/356 |
| 3,291,104 | 12/1966 | Zimmerman | 122/356 X |
| 3,407,789 | 10/1968 | Hallee et al. | 122/356 |

FOREIGN PATENTS OR APPLICATIONS

| | | | |
|---|---|---|---|
| 199,833 | 11/1965 | Sweden | 196/110 |

*Primary Examiner*—Morris O. Wolk
*Assistant Examiner*—Bradley Garris
*Attorney, Agent, or Firm*—Karl F. Ross; Herbert Dubno

[57] ABSTRACT

A tube furnace, especially for the cracking of hydrocarbons, comprises a heat and combustion chamber in which the hydrocarbons are passed through a plurality of tube coils lying in planes parallel to the walls of the chamber and having predominantly vertical stretches. Preferably, a plurality of tube coils is provided and lies along respective walls of the vessel with each pair of tube coils communicating with a common tube coil of larger cross section extending into the interior of the chamber.

3 Claims, 6 Drawing Figures

TUBE FURNACE, ESPECIALLY FOR THE CRACKING OF HYDROCARBONS

CROSS REFERENCE TO COPENDING APPLICATION

The present application is related to the commonly assigned copending application Ser. No. 463,103 filed April 22, 1974 by Armin Dorner and Walter Kreuter and entitled Tube Furnace for the Cracking of Organic Feed Stock.

FIELD OF THE INVENTION

The present invention relates to a tube furnace for the cracking of organic feed stocks as described in the aforementioned copending application and, more particularly, to a furnace in which the hydrocarbons is passed through tubes in a combustion chamber provided with burners to generate the temperatures necessary to crack the hydrocarbons.

BACKGROUND OF THE INVENTION

There have already been described tube furnaces for the thermal cracking of hydrocarbon which comprise two opposing relatively small walls and two opposing relatively large walls which together define a furnace chamber through which pipes or tubes extend to conduct the hydrocarbon from an inlet side to an outlet side. The lateral walls of the furnace chamber are provided with burners supplied with fuel to generate the heat necessary for thermal cracking of the hydrocarbons within the tubes. The hydrocarbon to be cracked is conducted, via a feed pipe system through a convection zone lying above the combustion chamber and in which the hydrocarbons are preheated, to the furnace tube from which through the floor of the combustion chamber, the cracked hydrocarbons or cracking product is removed.

Thermal cracking of the hydrocarbons requires extremely high temperatures and short residence time as described in the aforementioned copending application. However, a further shortening of the residence time has been found to be impractical and it is, of course, desirable to operate with the highest operative temperature within the furnace. In fact, it is desirable to operate with temperatures as high as the material, from which the tubes and other furnace components are formed, can withstand.

In spite of the high temperatures and low residence times which are conventionally employed, it is found that the capital expenditures for tube furnaces for the hydrocarbon cracking and the operating cost thereof is not satisfactory.

Furthermore, the efficiency of conventional thermal-cracking tube furnaces leaves much to be desired.

OBJECT OF THE INVENTION

It is an object of the present invention to provide an improved tube furnace for the thermal cracking of hydrocarbons.

It is another object of the invention to extend the principles originally set forth in the aforementioned copending application.

It is still another object of the invention to provide a tube furnace for the purpose described which will have augmented operating efficiency.

Still another object of the invention is to provide a tube furnace for the thermal cracking of hydrocarbons which is free from the disadvantages mentioned above and which is of low capital cost and has low operating costs as well.

SUMMARY OF THE INVENTION

These objects are attained, in accordance with the present invention, in a tube furnace for the thermal cracking of hydrocarbons which comprises a plurality of mutually opposing walls and a floor defining a furnace chamber, respective tube coils with predominantly vertical-pass tubes lying in vertical planes parallel to and closely juxtaposed with the lateral walls, and burners provided in the walls and in the floor. According to the principles of the invention, the spatial relationship of the tubes and the floor burners premits greater utilization of the space of the combustion chamber and of the entire apparatus so that the capital and operating costs are minimized. The total tube length can be increased within a given space and thus the heat transfer surface can be increased so that, for a given operating temperature, the amount of heat transferred to the hydrocarbon through the walls of the tubes can be raised.

According to the present invention, not only are the lateral walls of the chamber provided with burners in direct juxtaposition with the tube coils lying therealong, but the burners are provided in the floor of the combustion chambers in addition to the wall burners.

It has been found to advantage to provide the tube coils in a meander configuration, i.e. with successive loops in a plane parallel to the walls.

According to an important feature of the invention, moreover, at least two tube coils along a path of walls of the chamber communicate jointly with a single coil of correspondingly increased cross sections, i.e. a cross section equal at least to that of the two tube coils opening into it, the larger-cross section tube coil being disposed closer to the center of the combustion chamber than the tubes with smaller cross sections.

Since the heat transfer surface, under constant flow cross sections, falls with increasing tube diameter, it is possible in this manner to provide a greater heat exchange surface at the inlet side of the system in which the hydrocarbon passes through two tubes, than in the discharge side when the streams of hydrocarbon are united in a common tube.

According to the invention, moreover, the tubes extend toward the center of the chamber to form intersecting planar arrays of crossing tube arrays at the center at which all of the larger diameter tubes are provided with a common outlet. The inlets for the hydrocarbon to be cracked are preferably provided at locations most remote from the center of the chamber, i.e. at the diagonally opposite corners thereof.

Since the hydrocarbon is more rapidly heated in the smaller-cross section tubes with greater specific heat exchange surface than in the larger diameter tubes with smaller specific heat exchange surface, the temperature of the hydrocarbon in the region of the inlet rises rapidly to the cracking temperature at which the hydrocarbon can be maintained throughout its passage through the remainder of the tubes. Thus the major part of the transit of the hydrocarbon through the tubes takes place in a constant temperature and the useful life of the tubes is increased because thermal stress and temperature peaks are minimized.

Most advantageously, four such chambers are provided about a central chimney or stack through which the combustion products are discharged.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
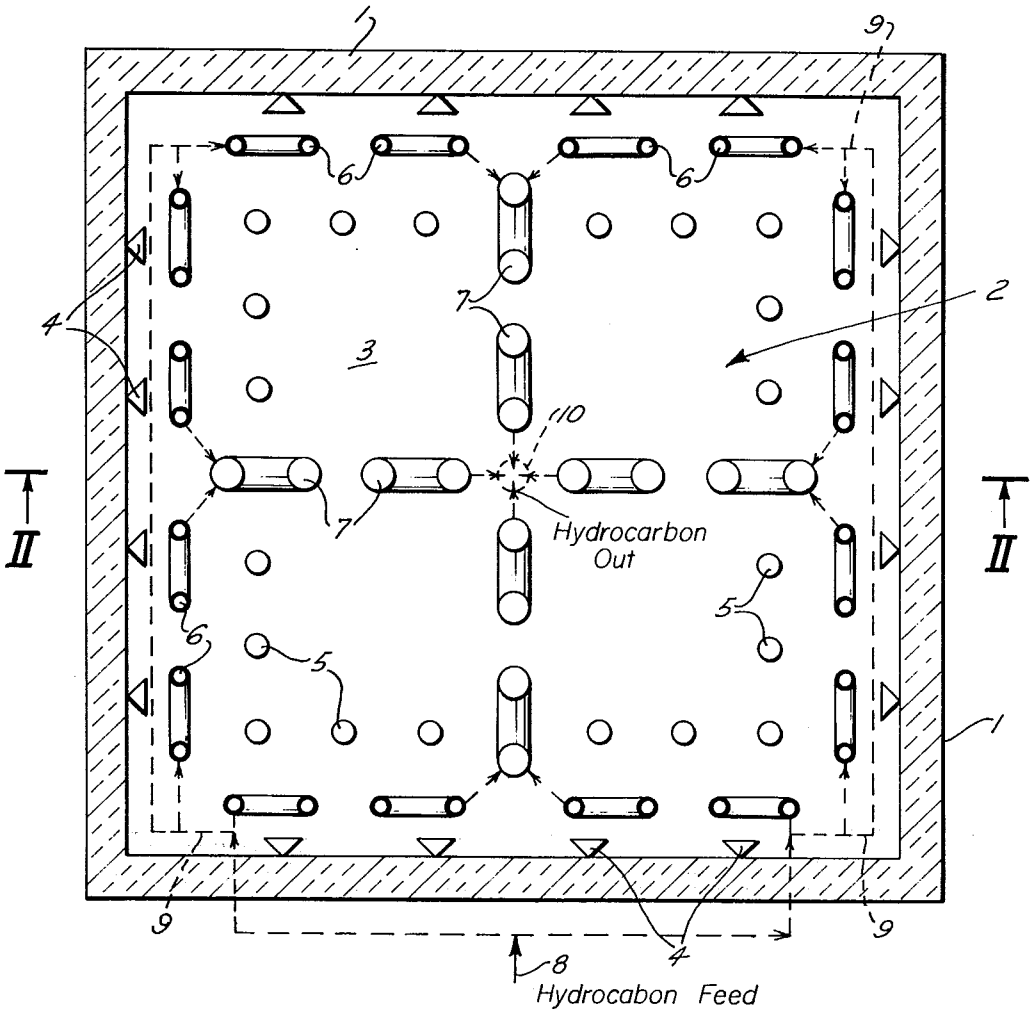
FIG. 1 is a horizontal section through a tube furnace, shown somewhat diagrammatically, embodying the present invention, pipe connections being shown schematically in broken lines.
Figure 3:
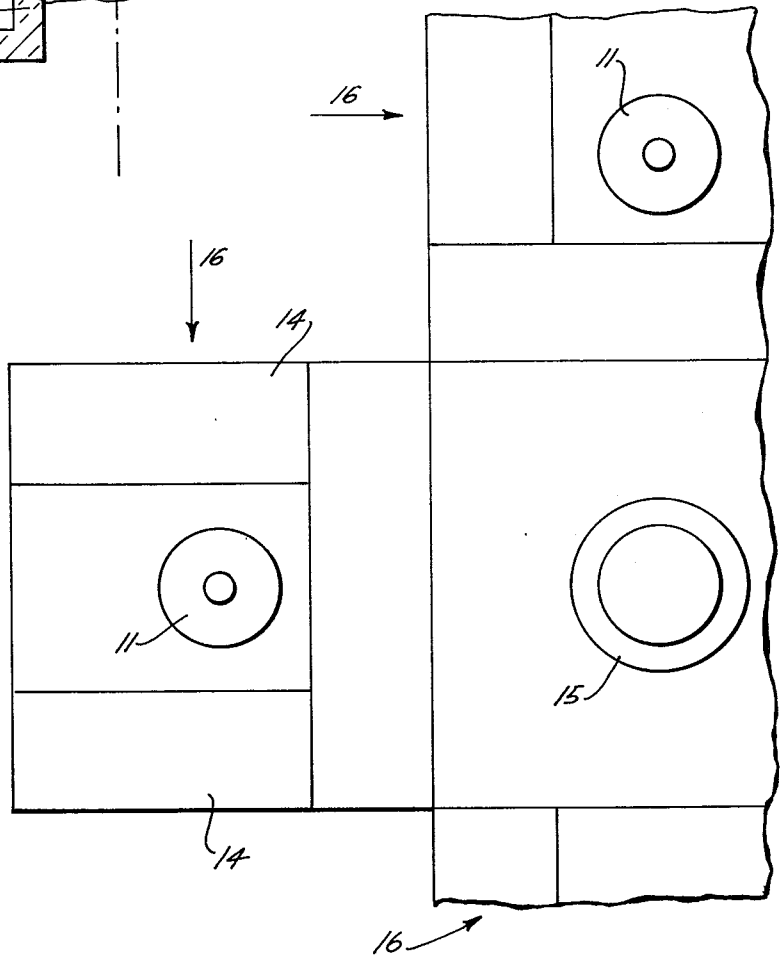
FIG. 3 is a plan view showing the tube furnace according to the invention having four combustion chambers centered on a common stack, each chamber being constituted as shown in FIGS. 1 and 2.
Figure 2:
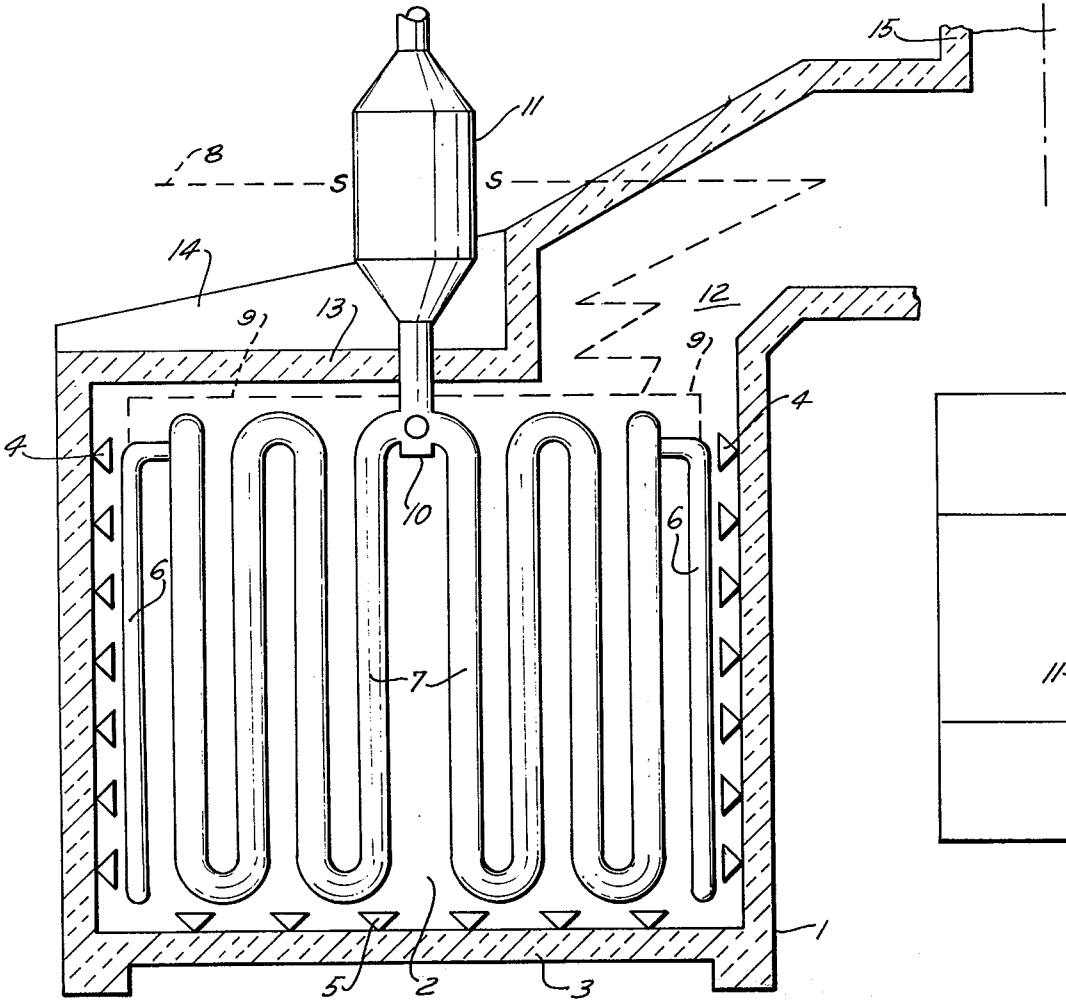
FIG. 2 is a section taken in a vertical plane corresponding to the line II—II of FIG. 1.

In the drawing, similar parts have been designated by identical reference numerals. It will be understood that FIGS. 1,2 and 5 show a single chamber of a tube furnace according to the invention, four such chambers being provided about a common stack as shown in FIG. 3. Furthermore, the floor burners of FIGS. 4*a* and 4*b* may be provided within the chambers of FIGS. 1,2 and 5 and, conversely, the wall burners of the latter chamber can be provided in the system of FIGS. 4*a* and 4*b*.

From FIGS. 1, 2 and 5, it will be apparent that the combustion chamber is of square plan view and is defined by a plurality of vertical lateral walls 1 and a floor 3.

All four walls 1 and the floor 3 of the combustion chamber are provided with burners 4 and 5, which may be supplied by gas or fuel oil and air in the conventional manner, the burners being disposed in a row immediately inwardly of the tube coils 6 while the burners 4 are directly juxtaposed with the vertical passes of these coils.

Along each wall 1, there are provided two coplanar tube coils 6 (see FIG. 5) which jointly communicate with a tube coil 7 at a junction 7', the tube coil 7 extending toward the center of the chamber. The tube coil 7 here has twice the floor cross section of each of the individual tube coils 6 communicating therewith. In the illustrated embodiment, the diameter of the tube of coil 6 is represented at D and the diameter of the tube of coil 7 is represented as 2D.

Each of the tube coils is constituted as a planar meander with primary vertical stretches connected by bights or bends at the top and bottom. The tube coils 6 lie parallel to and are closely juxtaposed with the respective walls 1 of the chamber 2, while the tube coils 7 lie along vertical median planes of the chamber bisecting perpendicularly each of the walls 1.

The tube coils 6 of smaller cross section are provided with inlet pipes 8 and 9 at the diagonally opposite corners of the chamber (see FIGS. 1 and 2) while the larger diameter tube coils 7 meet at the center of the chamber and are provided with a common outlet duct 10. The outlet duct 10 may communicate with a quenching cooler 11 shown diagrammatically in FIG. 2.

In accordance with conventional practices, the ducts 8 and 9 feeding the hydrocarbon to the system may pass first through a convection zone 12 above the combustion chamber which communicates with the central chimney common to four such combustion chambers. The roof of the combustion chamber 2 is formed from a horizontal slab 13 which rises inwardly in the convection zone 12 to eventually open into the chimney 15. The exhaust gas compartment 14 traps the hot exhaust gases for use in preheating the hydrocarbon passed through the pipe systems 8,9.

Figure 4A:
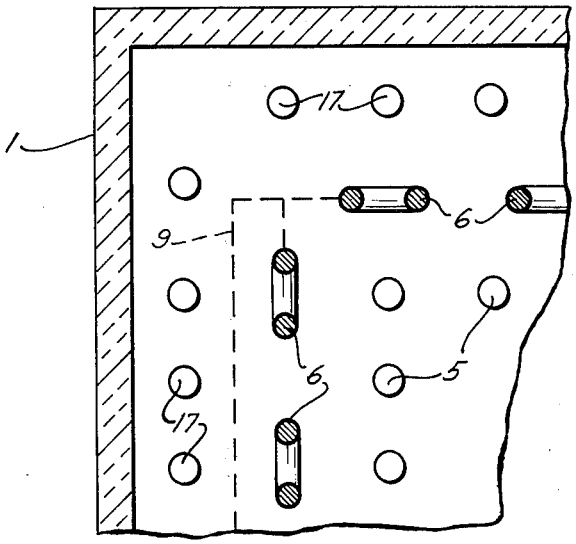
FIG. 4*a* is a section similar to FIG. 1 showing a system according to the invention with burners in the floor of the combustion chamber.
Figure 4B:
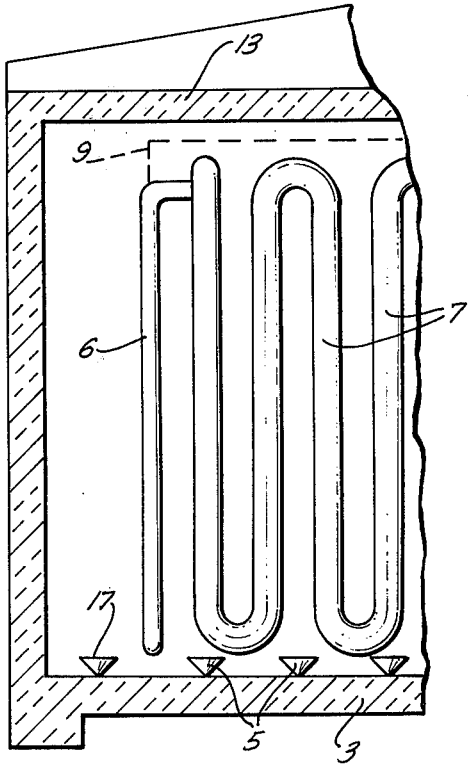
FIG. 4*b* is a vertical section through the chamber of FIG. 4*a;*.
Figure 5:
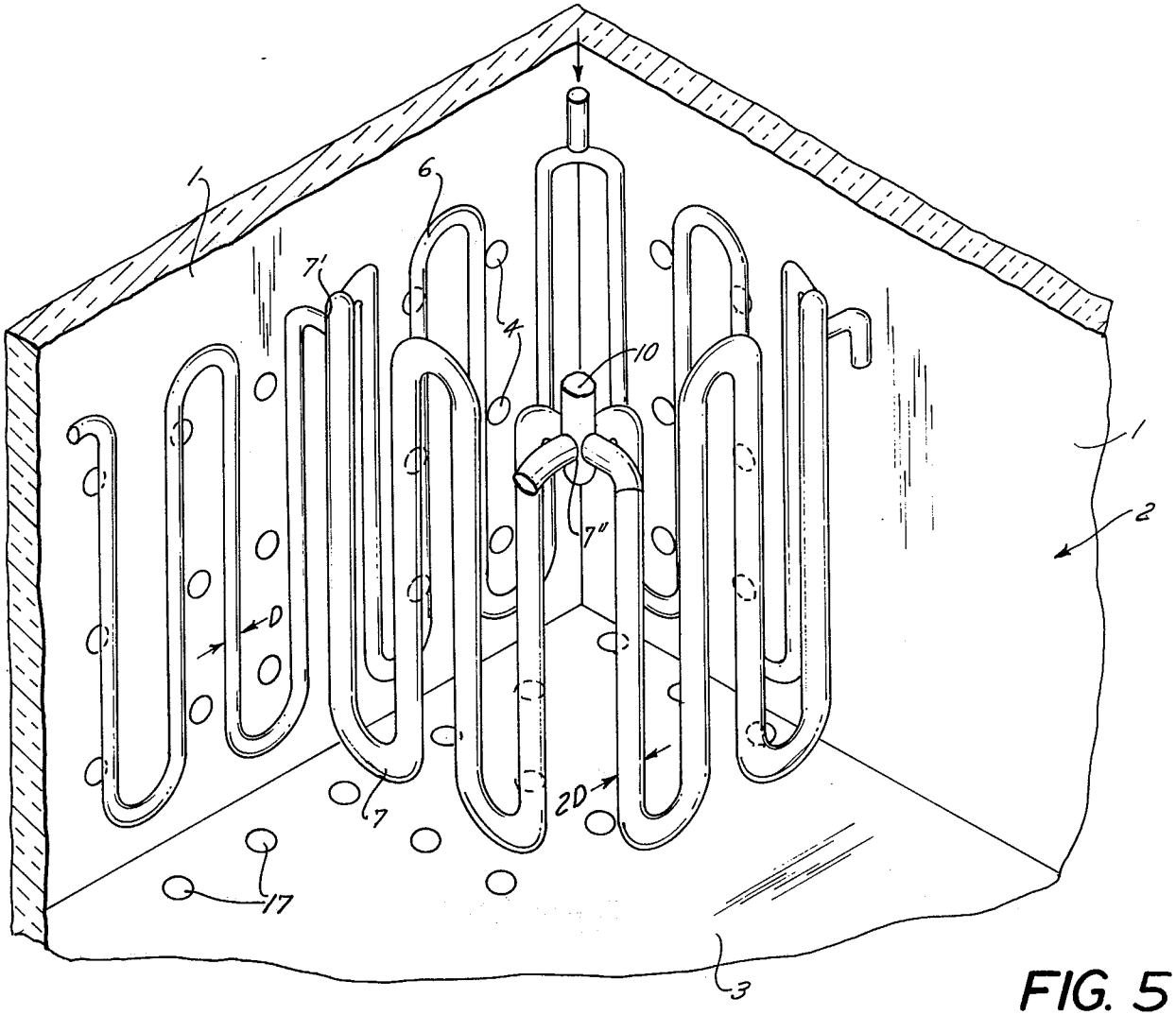
FIG. 5 is a diagrammatic perspective view showing a corner of the chamber of FIGS. 1 and 2.

FIG. 4*a* and 4*b* show an arrangement in which a further row of floor burners 17 may be provided outwardly of the planar area of tube coils which lie parallel to the walls 1 of the chamber.

I claim:

1. In a tube furnace for the thermal cracking of hydrocarbons, said tube furnace comprising:

a rectangular combustion chamber having a plurality of angularly adjoining vertical walls and a floor, a multiplicity of burners disposed along said walls and on said floor, a pair of undulating first tubes along each of said walls and at least one undulating second tube of larger flow cross section than each of the respective first tubes in said chamber communicating with the respective pair of first tubes, said first and second tubes all being formed with vertical conduit stretches interconnected by upper and lower bends, feed means for feeding hydrocarbons to be cracked to said first tubes, and outlet means for withdrawiing cracked hydrocarbons from said second tube, the improvement wherein:

a. each pair of said first tubes lies in a single plane parallel to and inwardly of the respective wall;

b. each of said second tubes lies in a plane perpendicular to the plane of the pair of the respective first tubes and the latter lie to opposite sides of the plane of the respective second tube;

c. said second tubes meet at said outlet means and said outlet means is disposed at the center of said chamber; and d. said feed means is connected to said first tubes at the corners of said chamber.

2. The improvement defined in claim 1 wherein at least two such chambers are disposed about a common chimney for venting exhaust gases from said chambers, said chambers being disposed symmetrically with respect to said chimney.

3. The improvement defined in claim 2 wherein at least four such chambers are provided axially symmetrically about and communicating with said chimney.

* * * * *